US010030489B2

(12) United States Patent
Romer et al.

(10) Patent No.: US 10,030,489 B2
(45) Date of Patent: Jul. 24, 2018

(54) SYSTEMS AND METHODS FOR ARTIFICIAL LIFT VIA A DOWNHOLE PIEZOELECTRIC PUMP

(71) Applicants: Michael C. Romer, The Woodlands, TX (US); Federico A. Tavarez, Pearland, TX (US); Randy C. Tolman, Spring, TX (US)

(72) Inventors: Michael C. Romer, The Woodlands, TX (US); Federico A. Tavarez, Pearland, TX (US); Randy C. Tolman, Spring, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 998 days.

(21) Appl. No.: 14/321,583

(22) Filed: Jul. 1, 2014

(65) Prior Publication Data

US 2015/0060083 A1 Mar. 5, 2015

Related U.S. Application Data

(60) Provisional application No. 61/870,657, filed on Aug. 27, 2013.

(51) Int. Cl.

| | |
|---|---|
| ***E21B 43/12*** | (2006.01) |
| ***E21B 23/00*** | (2006.01) |
| ***F04B 47/06*** | (2006.01) |

(52) U.S. Cl.

CPC ..... *E21B 43/128* (2013.01); *E21B 23/00* (2013.01); *F04B 47/06* (2013.01)

(58) Field of Classification Search

CPC combination set(s) only.
See application file for complete search history.

(56) References Cited

U.S. PATENT DOCUMENTS

| | | | |
|---|---|---|---|
| 6,328,102 | B1 | 12/2001 | Dean |
| 7,111,675 | B2 | 9/2006 | Zisk, Jr. |
| 7,322,803 | B2 | 1/2008 | Vogeley |
| 7,484,940 | B2 | 2/2009 | O'Niell |
| 7,597,150 | B2 | 10/2009 | Clem |
| 8,133,041 | B2 | 3/2012 | Ludlow et al. |
| 8,220,533 | B2 | 7/2012 | Longfield et al. |
| 8,511,390 | B2 | 8/2013 | Coyle et al. |
| 2006/0198742 | A1 † | 9/2006 | DiFoggio |
| 2008/0080991 | A1 | 4/2008 | Yuratich et al. |
| 2012/0263606 | A1 | 10/2012 | Bouldin et al. |
| 2014/0037471 | A1 † | 2/2014 | Kuznetsov |

FOREIGN PATENT DOCUMENTS

| | | |
|---|---|---|
| RU | WO2014027931 A1 † | 2/2014 |
| WO | WO 2009/077714 | 6/2009 |

† cited by third party

*Primary Examiner* — Yong-Suk Ro
(74) *Attorney, Agent, or Firm* — ExxonMobil Upstream Research Company-Law Department

(57) ABSTRACT

Systems and methods for artificial lift via a downhole piezoelectric pump including methods of removing a wellbore liquid from a wellbore that extends within a subterranean formation and/or methods of locating the downhole piezoelectric pump within the wellbore. The systems include hydrocarbon wells that include the wellbore, a casing, the downhole piezoelectric pump, and a liquid discharge conduit and the systems may be utilized with and/or configured to perform the methods.

19 Claims, 6 Drawing Sheets

SYSTEMS AND METHODS FOR ARTIFICIAL LIFT VIA A DOWNHOLE PIEZOELECTRIC PUMP

CROSS REFERENCE TO RELATED APPLICATIONS

This application claims the benefit of U.S. Provisional No. 61/870,657, filed Aug. 27, 2013, the entirety of which is incorporated herein by reference for all purposes.

FIELD OF THE DISCLOSURE

The present disclosure is directed generally to systems and methods for artificial lift in a wellbore and more specifically to systems and methods that utilize a downhole piezoelectric pump to remove a wellbore liquid from the wellbore.

BACKGROUND OF THE DISCLOSURE

A hydrocarbon well may be utilized to produce gaseous hydrocarbons from a subterranean formation. Often, a wellbore liquid may build up within one or more portions of the hydrocarbon well. This wellbore liquid, which may include water, condensate, and/or liquid hydrocarbons, may impede flow of the gaseous hydrocarbons from the subterranean formation to a surface region via the hydrocarbon well, thereby reducing and/or completely blocking gaseous hydrocarbon production from the hydrocarbon well.

Traditionally, plunger lift and/or rod pump systems have been utilized to provide artificial lift and to remove this wellbore liquid from the hydrocarbon well. While these systems may be effective under certain circumstances, they may not be capable of efficiently removing the wellbore liquid from long and/or deep hydrocarbon wells, from hydrocarbon wells that include one or more deviated (or nonlinear) portions (or regions), and/or from hydrocarbon wells in which the gaseous hydrocarbons do not generate at least a threshold pressure.

As an illustrative, non-exclusive example, plunger lift systems require that the gaseous hydrocarbons develop at least the threshold pressure to provide a motive force to convey a plunger between the subterranean formation and the surface region. As another illustrative, non-exclusive example, rod pump systems utilize a mechanical linkage (i.e., a rod) that extends between the surface region and the subterranean formation; and, as the depth of the well (or length of the mechanical linkage) is increased, the mechanical linkage becomes more prone to failure and/or more prone to damage the casing. As yet another illustrative, non-exclusive example, neither plunger lift systems nor rod pump systems may be utilized effectively in wellbores that include deviated and/or nonlinear regions.

Improved hydrocarbon well drilling technologies permit an operator to drill a hydrocarbon well that extends for many thousands of meters within the subterranean formation, that has a vertical depth of hundreds, or even thousands, of meters, and/or that has a highly deviated wellbore. These improved drilling technologies are routinely utilized to drill long and/or deep hydrocarbon wells that permit production of gaseous hydrocarbons from previously inaccessible subterranean formations. However, wellbore liquids cannot be removed efficiently from these hydrocarbon wells using traditional artificial lift systems. Thus, there exists a need for improved systems and methods for artificial lift to remove wellbore liquids from a hydrocarbon well.

SUMMARY OF THE DISCLOSURE

Systems and methods for artificial lift via a downhole piezoelectric pump are disclosed herein. The methods may include methods of removing a wellbore liquid from a wellbore that extends within a subterranean formation. These methods include electrically powering the downhole piezoelectric pump and pumping the wellbore liquid from the wellbore with the downhole piezoelectric pump. The pumping may include pressurizing the wellbore liquid with the downhole piezoelectric pump to generate a pressurized wellbore liquid at a discharge pressure and flowing the pressurized wellbore liquid at least a threshold vertical distance to a surface region at a discharge flow rate of at least 0.75, and less than 16, cubic meters (approximately 5 to approximately 100 barrels) per day.

In some embodiments, the pressurizing may include pressurizing to a discharge pressure of at least 25 MPa, continuously pumping the wellbore liquid from the wellbore, and/or pumping with at least a threshold pumping efficiency of at least 50%. In some embodiments, the pumping may include repeatedly transitioning a piezoelectric element between an extended state and a contracted state. In some embodiments, these methods further may include detecting a downhole process parameter and controlling the operation of the downhole piezoelectric pump responsive, at least in part, to the detected downhole process parameter. In some embodiments, these methods further may include controlling the discharge flow rate and/or the discharge pressure, such as responsive at least in part to the detected process parameter. In some embodiments, these methods further may include detecting a gas lock condition of the downhole piezoelectric pump and opening a liquid inlet valve of the downhole piezoelectric pump responsive to detecting the gas lock condition.

The methods also may include methods of locating (i.e., inserting and/or positioning) the downhole piezoelectric pump within the wellbore. These methods may include locating the downhole piezoelectric pump within a casing conduit of a casing that extends within the wellbore by locating the downhole piezoelectric pump within a lubricator that is in selective fluid communication with the casing conduit. These methods further may include conveying the downhole piezoelectric pump through a non-linear region of the casing conduit until the downhole piezoelectric pump is located at least a threshold vertical distance from the surface region.

In some embodiments, the conveying may include flowing the downhole piezoelectric pump through the casing conduit with a fluid flow. In some embodiments, the downhole piezoelectric pump defines a length of less than 10 meters. In some embodiments, the downhole piezoelectric pump includes fewer than three stages.

The systems include hydrocarbon wells that include the wellbore, a casing, the downhole piezoelectric pump, and a liquid discharge conduit and may be utilized with and/or configured to perform the methods. In some embodiments, the downhole piezoelectric pump may be located at least 1000 meters from a surface region and/or may be located downhole from a nonlinear region of the casing conduit. In some embodiments, the hydrocarbon well further includes a controller that is programmed to control the operation of the downhole piezoelectric pump. In some embodiments, the hydrocarbon well includes a sensor that is configured to detect a downhole process parameter. In some embodiments, the controller is programmed or otherwise configured to control the operation of the downhole piezoelectric pump responsive, at least in part, to the detected downhole process parameter.

DETAILED DESCRIPTION AND BEST MODE OF THE DISCLOSURE

Figure 1:
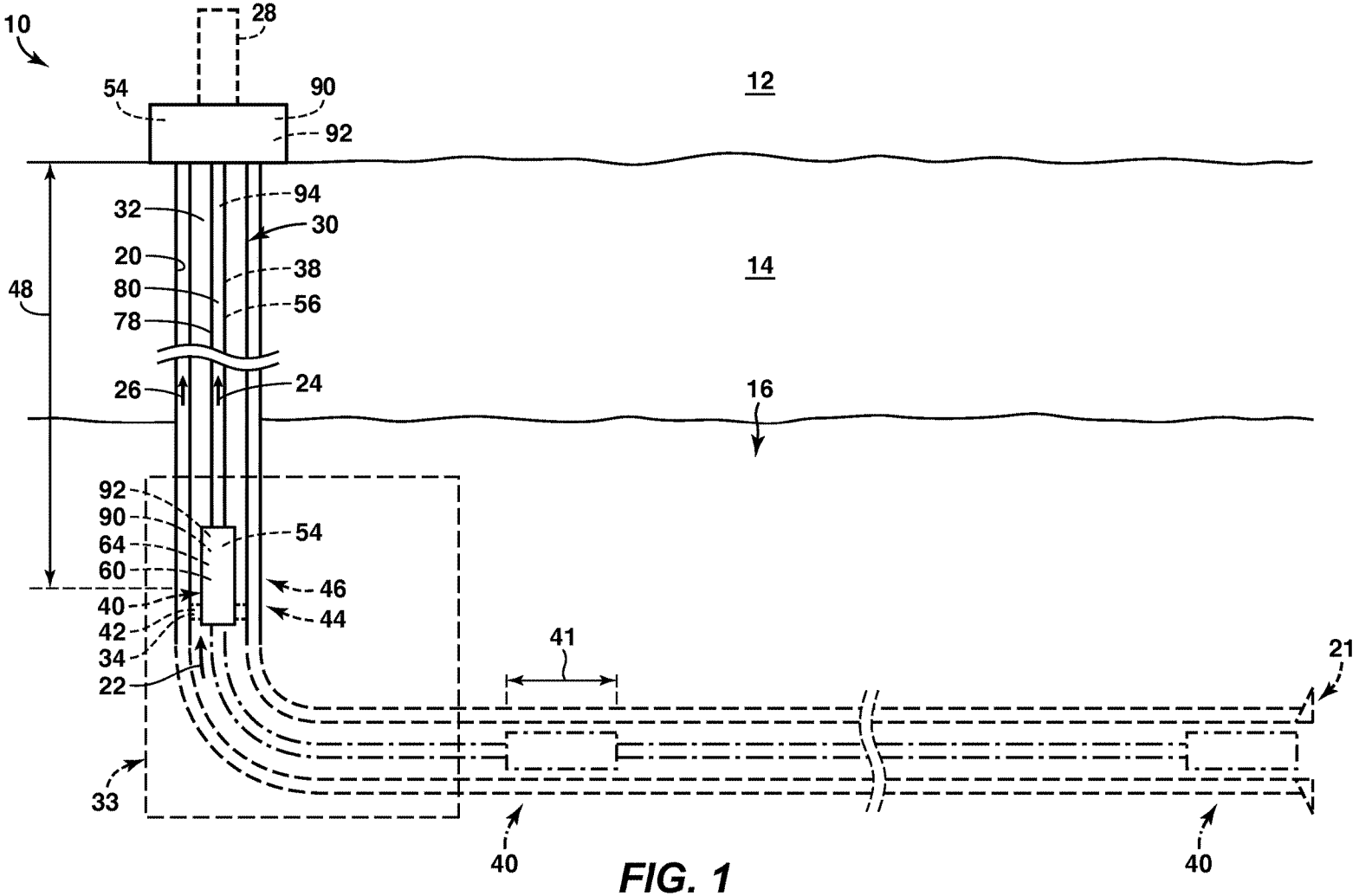
FIG. 1 is a schematic representation of illustrative, non-exclusive examples of a hydrocarbon well that may be utilized with and/or may include the systems and methods according to the present disclosure.

FIGS. 1-5 provide illustrative, non-exclusive examples of hydrocarbon wells 10 according to the present disclosure and of downhole piezoelectric pumps 40 according to the present disclosure that may be utilized in and/or with hydrocarbon wells 10. All elements may not be labeled in each of FIGS. 1-5, but reference numerals associated therewith may be utilized herein for consistency. Elements, components, and/or features that are discussed herein with reference to one or more of FIGS. 1-5 may be included in and/or utilized with any of FIGS. 1-5 without departing from the scope of the present disclosure.

In general, elements that are likely to be included in a given (i.e., a particular) embodiment are illustrated in solid lines, while elements that are optional to a given embodiment are illustrated in dashed lines. However, elements that are shown in solid lines are not essential to all embodiments, and an element shown in solid lines may be omitted from a particular embodiment without departing from the scope of the present disclosure.

Figure 2:
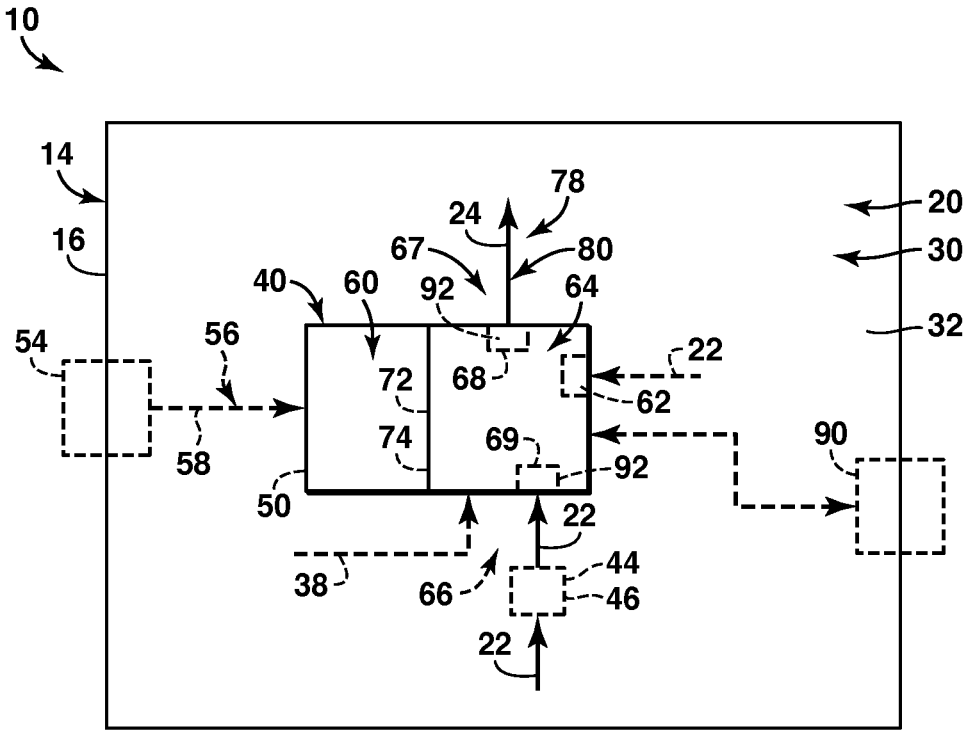
FIG. 2 is a schematic block diagram of illustrative, non-exclusive examples of a downhole piezoelectric pump according to the present disclosure.

FIG. 1 is a schematic representation of illustrative, non-exclusive examples of a hydrocarbon well 10 that may be utilized with and/or include the systems and methods according to the present disclosure, while FIG. 2 is a schematic block diagram of illustrative, non-exclusive examples of a downhole piezoelectric pump 40 according to the present disclosure that may be utilized with hydrocarbon well 10. Hydrocarbon well 10 includes a wellbore 20 that extends between a surface region 12 and a subterranean formation 16 that is present within a subsurface region 14. The hydrocarbon well further includes a casing 30 that extends within the wellbore and defines a casing conduit 32. Downhole piezoelectric pump 40 is located within the casing conduit at least a threshold vertical distance 48 from surface region 12 (as illustrated in FIG. 1). Threshold vertical distance 48 additionally or alternatively may be referred to herein as threshold vertical depth 48. The downhole piezoelectric pump is configured to receive a wellbore liquid 22 and to pressurize the wellbore liquid to generate a pressurized wellbore liquid 24. A tubing 78 defines a liquid discharge conduit 80 that may extend between downhole piezoelectric pump 40 and surface region 12. The liquid discharge conduit is in fluid communication with casing conduit 32 via piezoelectric pump 40 and is configured to convey pressurized wellbore liquid 24 from the casing conduit, such as to surface region 12.

As illustrated in dashed lines in FIG. 1, hydrocarbon well 10 may include a lubricator 28 that may be utilized to locate (i.e., insert and/or position) downhole piezoelectric pump 40 within casing conduit 32 and/or to remove the downhole piezoelectric pump from the casing conduit. In addition, and as illustrated in FIGS. 1-2, an injection conduit 38 may extend between surface region 12 and downhole piezoelectric pump 40 and may be configured to inject a corrosion inhibitor and/or a scale inhibitor into casing conduit 32 and/or into fluid contact with downhole piezoelectric pump 40, such as to decrease a potential for corrosion of and/or scale build-up within the downhole piezoelectric pump.

As also illustrated in dashed lines, hydrocarbon well 10 and/or downhole piezoelectric pump 40 further may include a sand control structure 44, which may be configured to limit flow of sand into an inlet 66 of downhole piezoelectric pump 40, and/or a gas control structure 46, which may limit flow of a wellbore gas 26 (as illustrated in FIG. 1) into inlet 66 (as illustrated in FIG. 2) of downhole piezoelectric pump 40. As further illustrated in dashed lines in FIG. 1, casing 30 may have a seat 34 attached thereto and/or included therein, with seat 34 being configured to receive downhole piezoelectric pump 40 and/or to retain downhole piezoelectric pump 40 at, or within, a desired region and/or location within casing 30. Additionally or alternatively, downhole piezoelectric pump 40 may include and/or be operatively attached to a packer 42. Packer 42 may be configured to swell or otherwise be expanded within casing conduit 32 and to thereby retain downhole piezoelectric pump 40 at, or within, the desired region and/or location within casing 30.

Returning to FIGS. 1-2, hydrocarbon well 10 and/or downhole piezoelectric pump 40 thereof further may include a power source 54 that is configured to provide an electric current to downhole piezoelectric pump 40. In addition, a sensor 92 may be configured to detect a downhole process parameter and may be located within wellbore 20, may be operatively attached to downhole piezoelectric pump 40, and/or may form a portion of the downhole piezoelectric pump. The sensor may be configured to convey a data signal that is indicative of the process parameter to surface region 12 and/or may be in communication with a controller 90 that is configured to control the operation of at least a portion of downhole piezoelectric pump 40.

As also discussed, downhole piezoelectric pump 40 may be powered by (or receive an electric current 58 from) power source 54, which may be operatively attached to the downhole piezoelectric pump, may form a portion of the downhole piezoelectric pump, and/or may be in electrical communication with the downhole piezoelectric pump via an electrical conduit 56. Thus, downhole piezoelectric pump 40 according to the present disclosure may be configured to generate pressurized wellbore liquid 24 without utilizing a reciprocating mechanical linkage that extends between surface region 12 and the downhole piezoelectric pump (such as might be utilized with traditional rod pump systems) to provide a motive force for operation of the downhole piezoelectric pump. This may permit downhole piezoelectric pump 40 to be utilized in long, deep, and/or deviated wellbores where traditional rod pump systems may be ineffective, inefficient, and/or unable to generate the pressurized wellbore liquid 24.

Similarly, and since downhole piezoelectric pump 40 is powered by power source 54, the downhole piezoelectric pump may be configured to generate pressurized wellbore liquid 24 (and/or to remove the pressurized wellbore liquid from casing conduit 32 via liquid discharge conduit 80) without requiring a threshold minimum pressure of wellbore gas 26. This may permit downhole piezoelectric pump 40 to be utilized in hydrocarbon wells 10 that do not develop sufficient gas pressure to permit utilization of traditional plunger lift systems and/or that define long and/or deviated casing conduits 32 that preclude the efficient operation of traditional plunger lift systems.

Furthermore, downhole piezoelectric pump 40 may operate as a positive displacement pump and thus may be sized, designed, and/or configured to generate pressurized wellbore liquid 24 at a pressure that is sufficient to permit the pressurized wellbore liquid to be conveyed via liquid discharge conduit 80 to surface region 12 without utilizing a large number of pumping stages. It follows that reducing the number of pumping stages may decrease a length 41 of the downhole piezoelectric pump (as illustrated in FIG. 1). As illustrative, non-exclusive examples, downhole piezoelectric pump 40 may include fewer than five stages, fewer than four stages, fewer than three stages, or a single stage.

As additional illustrative, non-exclusive examples, the length of the downhole piezoelectric pump may be less than 30 meters (m), less than 28 m, less than 26 m, less than 24 m, less than 22 m, less than 20 m, less than 18 m, less than 16 m, less than 14 m, less than 12 m, less than 10 m, less than 8 m, less than 6 m, or less than 4 m. Additionally or alternatively, an outer diameter of the downhole piezoelectric pump may be less than 20 centimeters (cm), less than 18 cm, less than 16 cm, less than 14 cm, less than 12 cm, less than 10 cm, less than 9 cm, less than 8 cm, less than 7 cm, less than 6 cm, or less than 5 cm.

This (relatively) small length and/or (relatively) small diameter of downhole piezoelectric pumps 40 according to the present disclosure may permit the downhole piezoelectric pumps to be located within and/or to flow through and/or past deviated regions 33 within wellbore 20 and/or casing conduit 32. These deviated regions might obstruct and/or retain longer and/or larger-diameter traditional pumping systems that do not include downhole piezoelectric pump 40 and/or that utilize a larger number (such as more than 5, more than 6, more than 8, more than 10, more than 15, or more than 20) of stages to generate pressurized wellbore liquid 24. Thus, downhole piezoelectric pumps 40 according to the present disclosure may be operable in hydrocarbon wells 10 that are otherwise inaccessible to more traditional artificial lift systems. This may include locating downhole piezoelectric pump 40 uphole from deviated regions 33, as schematically illustrated in dashed lines in FIG. 1, and/or locating downhole piezoelectric pump 40 downhole from deviated regions 33, such as in a horizontal portion of wellbore 20 and/or near a toe end 21 of wellbore 20 (as schematically illustrated in dash-dot lines in FIG. 1).

Additionally or alternatively, the (relatively) small length and/or the (relatively) small diameter of downhole piezoelectric pumps 40 according to the present disclosure may permit the downhole piezoelectric pumps to be located within casing conduit 32 and/or removed from casing conduit 32 via lubricator 28. This may permit the downhole piezoelectric pumps to be located within the casing conduit without depressurizing hydrocarbon well 10, without killing well 10, without first supplying a kill weight fluid to wellbore 20, and/or while containing wellbore fluids within the wellbore. This may increase an overall efficiency of operations that insert downhole piezoelectric pumps into and/or remove downhole piezoelectric pumps from wellbore 20, may decrease a time required to permit downhole piezoelectric pumps 40 to be inserted into and/or removed from wellbore 20, and/or may decrease a potential for damage to hydrocarbon well 10 when downhole piezoelectric pumps 40 are inserted into and/or removed from wellbore 20.

Furthermore, and as discussed in more detail herein, downhole piezoelectric pumps 40 according to the present disclosure may be configured to generate pressurized wellbore liquid 24 at relatively low discharge flow rates and/or at selectively variable discharge flow rates. This may permit downhole piezoelectric pumps 40 to efficiently operate in low production rate hydrocarbon wells and/or in hydrocarbon wells that generate low volumes of wellbore liquid 22, in contrast to more traditional artificial lift systems.

Downhole piezoelectric pump 40 includes a piezoelectric element 60 and a compression chamber 64. Piezoelectric element 60 may be configured to selectively and/or repeatedly transition from an extended state to a contracted state during an intake stroke of the downhole piezoelectric pump and to subsequently transition from the contracted state to the expanded state during an exhaust stroke of the downhole piezoelectric pump. This may include transitioning between the extended state and the contracted state responsive to receipt of electric current 58, which may be an AC electric current.

Compression chamber 64 may be configured to receive wellbore liquid 22 from wellbore 20, such as via inlet 66, during the intake stroke of the downhole piezoelectric pump and to emit, or discharge, pressurized wellbore liquid 24, such as through an outlet 67, during the exhaust stroke of the downhole piezoelectric pump. As illustrated schematically in FIG. 2 and discussed in more detail herein with reference to FIGS. 3-5, downhole piezoelectric pump 40 further may include a housing 50, an inlet check valve 69, an outlet check valve 68, a sealing structure 72, and/or an isolation structure 74. Downhole piezoelectric pump 40 also may include a liquid inlet valve 62. Liquid inlet valve 62 may be configured to selectively introduce wellbore liquid 22 into compression chamber 64 of downhole piezoelectric pump 40, as discussed in more detail herein.

As discussed, wellbore 20 may define deviated region 33, which also may be referred to herein as a nonlinear region 33, that may have a deviated (i.e., nonvertical) and/or nonlinear trajectory within subsurface region 14 and/or subterranean formation 16 thereof (as schematically illustrated in FIG. 1). In addition, and as also discussed, downhole piezoelectric pump 40 may be located downhole from deviated region 33. As illustrative, non-exclusive examples, nonlinear region 33 may include and/or be a tortuous region, a curvilinear region, an L-shaped region, an S-shaped region, and/or a transition region between a (substantially) horizontal region and a (substantially) vertical region that may define a tortuous trajectory, a curvilinear trajectory, a deviated trajectory, an L-shaped trajectory, an S-shaped trajectory, and/or a transitional, or changing, trajectory.

Power source 54 may include any suitable structure that may be configured to provide the electric current to downhole piezoelectric pump 40, and/or to piezoelectric element 60 thereof, and may be present in any suitable location. As an illustrative, non-exclusive example, power source 54 may be located in surface region 12, and electrical conduit 56 may extend between the power source and the downhole piezoelectric pump. Illustrative, non-exclusive examples of electrical conduit 56 include any suitable wire, cable, wireline, and/or working line, and electrical conduit 56 may connect to downhole piezoelectric pump 40 via any suitable electrical connection and/or wet-mate connection.

As another illustrative, non-exclusive example, power source 54 may include and/or be a battery pack. The battery pack may be located within surface region 12, may be located within wellbore 20, and/or may be operatively and/or directly attached to downhole piezoelectric pump 40.

As additional illustrative, non-exclusive examples, power source 54 may include and/or be a generator, an AC generator, a DC generator, a turbine, a solar-powered power source, a wind-powered power source, and/or a hydrocarbon-powered power source that may be located within surface region 12 and/or within wellbore 20. When power source 54 is located within wellbore 20, the power source also may be referred to herein as a downhole power generation assembly 54.

As discussed in more detail herein, a discharge flow rate of pressurized wellbore liquid 24 that is generated by downhole piezoelectric pump 40 may be controlled, regulated, and/or varied by controlling, regulating, and/or varying a frequency of an AC electric current that is provided to downhole piezoelectric pump 40 and/or to piezoelectric element 60 thereof. This may include increasing the frequency of the AC electric current to increase the discharge flow rate (by decreasing a time that it takes for the downhole piezoelectric pump to transition between the extended state and the contracted state) and/or decreasing the frequency of the AC electric current to decrease the discharge flow rate (by increasing the time that it takes for the downhole piezoelectric pump to transition between the extended state and the contracted state).

Illustrative, non-exclusive examples of the frequency of the AC electric current include frequencies of at least 0.01 Hertz (Hz), at least 0.05 Hz, at least 0.1 Hz, at least 0.5 Hz, at least 1 Hz, at least 5 Hz, at least 10 Hz, at least 20 Hz, at least 30 Hz, at least 40 Hz, at least 60 Hz, at least 80 Hz, and/or at least 100 Hz. Additional illustrative, non-exclusive examples of the frequency of the AC electric current include frequencies of less than 400 Hz, less than 350 Hz, less than 300 Hz, less than 250 Hz, less than 200 Hz, less than 150 Hz, less than 100 Hz, less than 75 Hz, less than 50 Hz, less than 25 Hz, less than 20 Hz, less than 15 Hz, and/or less than 10 Hz. Further illustrative, non-exclusive examples of the frequency of the AC electric current include frequencies in any range of the preceding minimum and maximum frequencies.

Sensor 92 may include any suitable structure that is configured to detect the downhole process parameter. Illustrative, non-exclusive examples of the downhole process parameter include a downhole temperature, a downhole pressure, a discharge pressure from the downhole piezoelectric pump, a downhole flow rate, and/or a discharge flow rate from the downhole piezoelectric pump.

It is within the scope of the present disclosure that sensor 92 may be configured to detect the downhole process parameter at any suitable location within wellbore 20. As an illustrative, non-exclusive example, the sensor may be located such that the downhole process parameter is indicative of a condition at an inlet to downhole piezoelectric pump 40. As another illustrative, non-exclusive example, the sensor may be located such that the downhole process parameter is indicative of a condition at an outlet from downhole piezoelectric pump 40.

When hydrocarbon well 10 includes sensor 92, the hydrocarbon well also may include a data communication conduit 94 (as illustrated in FIG. 1) that may be configured to convey a signal that is indicative of the downhole process parameter between sensor 92 and surface region 12. As an illustrative, non-exclusive example, controller 90 may be located within surface region 12, and data communication conduit 94 may convey the signal to the controller. As another illustrative, non-exclusive example, the data communication conduit may convey the signal to a display and/or to a terminal that is located within surface region 12.

Controller 90 may include any suitable structure that may be configured to control the operation of any suitable portion of hydrocarbon well 10, such as downhole piezoelectric pump 40. This may include controlling using methods 200 and/or methods 300, which are discussed in more detail herein.

As illustrated in FIG. 1, controller 90 may be located in any suitable portion of hydrocarbon well 10. As an illustrative, non-exclusive example, the controller may include and/or be an autonomous and/or automatic controller that is located within wellbore 20 and/or that is directly and/or operatively attached to downhole piezoelectric pump 40. Thus, controller 90 may be configured to control the operation of downhole piezoelectric pump 40 without requiring that a data signal be conveyed to surface region 12 via data communication conduit 94. Additionally or alternatively, controller 90 may be located within surface region 12 and may communicate with downhole piezoelectric pump 40 via data communication conduit 94.

As an illustrative, non-exclusive example, controller 90 may be programmed to maintain a target wellbore liquid level within wellbore 20 above downhole piezoelectric pump 40. This may include increasing a discharge flow rate of pressurized wellbore liquid 24 that is generated by the downhole piezoelectric pump to decrease the wellbore liquid level and/or decreasing the discharge flow rate to increase the wellbore liquid level.

As another illustrative, non-exclusive example, controller 90 may be programmed to regulate the discharge flow rate to control the discharge pressure from the downhole piezoelectric pump. This may include increasing the discharge flow rate to increase the discharge pressure and/or decreasing the discharge flow rate to decrease the discharge pressure.

As a more specific but still illustrative, non-exclusive example, and when hydrocarbon well 10 includes sensor 92, controller 90 may be programmed to control a frequency of the AC electric current that is provided to downhole piezoelectric pump 40 (and thus to control the discharge flow rate) based, at least in part, on the downhole process parameter. This may include increasing the frequency of the AC electric current to increase the discharge flow rate and/or decreasing the frequency of the AC electric current to decrease the discharge flow rate.

As another more specific but still illustrative, non-exclusive example, and when downhole piezoelectric pump 40 includes liquid inlet valve 62, controller 90 may be programmed to control the operation of the liquid inlet valve. This may include opening the liquid inlet valve to permit wellbore fluid to enter compression chamber 64 of the downhole piezoelectric pump responsive to the downhole process parameter indicating a gas lock condition of the downhole piezoelectric pump.

As discussed, downhole piezoelectric pump 40 according to the present disclosure may be utilized to provide artificial lift in wellbores that define a large vertical distance, or depth, 48, in wellbores that define a large overall length, and/or in wellbores in which downhole piezoelectric pump 40 is located at least a threshold vertical distance from surface region 12. As illustrative, non-exclusive examples, the vertical depth of wellbore 20, the overall length of wellbore 20, and/or the threshold vertical distance of downhole piezoelectric pump 40 from surface region 12 may be at least 250 meters (m), at least 500 m, at least 750 m, at least 1000 m, at least 1250 m, at least 1500 m, at least 1750 m, at least 2000 m, at least 2250 m, at least 2500 m, at least 2750 m, at least 3000 m, at least 3250 m, and/or at least 3500 m. Additionally or alternatively, the vertical depth of wellbore 20, the overall length of wellbore 20, and/or the threshold vertical distance of downhole piezoelectric pump 40 from surface region 12 may be less than 8000 m, less than 7750 m, less than 7500 m, less than 7250 m, less than 7000 m, less than 6750 m, less than 6500 m, less than 6250 m, less than 6000 m, less than 5750 m, less than 5500 m, less than 5250 m, less than 5000 m, less than 4750 m, less than 4500 m, less than 4250 m, and/or less than 4000 m. Further additionally or alternatively, the vertical depth of wellbore 20, the overall length of wellbore 20, and/or the threshold vertical distance of downhole piezoelectric pump 40 from surface region 12 may be in a range defined, or bounded, by any combination of the preceding maximum and minimum depths.

Figure 3:
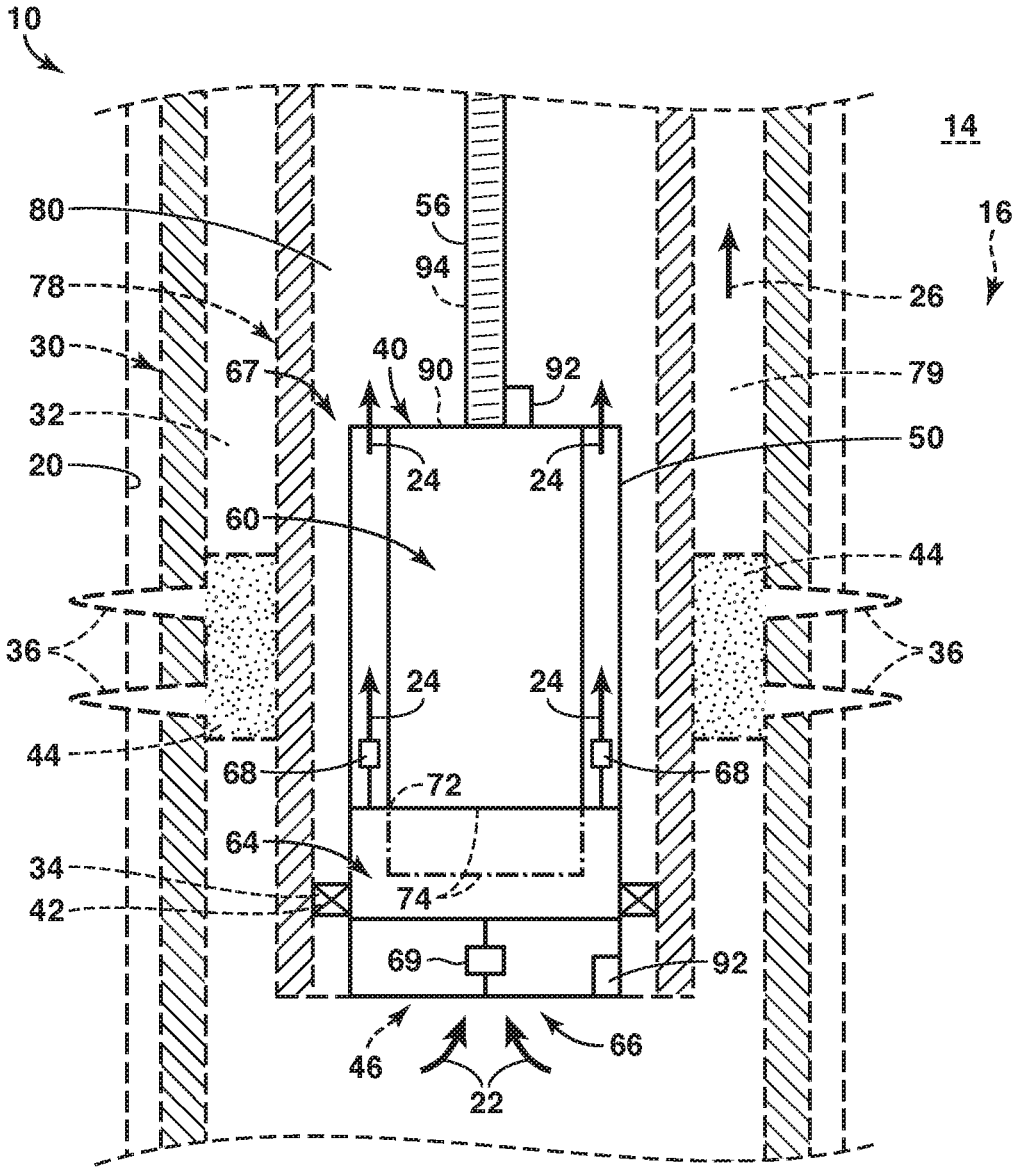
FIG. 3 is a fragmentary partial cross-sectional view of less schematic but still illustrative, non-exclusive examples of a hydrocarbon well that includes a downhole piezoelectric pump according to the present disclosure.

FIG. 3 provides less schematic but still illustrative, non-exclusive examples of a hydrocarbon well 10 that includes a downhole piezoelectric pump 40 according to the present disclosure. In FIG. 3, downhole piezoelectric pump 40 is located within a casing conduit 32 that is defined by a casing 30 that extends within a wellbore 20. Casing 30 includes a plurality of perforations 36 that provide fluid communication between casing conduit 32 and a subterranean formation 16 that is present within a subsurface region 14. Downhole piezoelectric pump 40 is retained within a liquid discharge conduit 80 by a seat 34 and/or by a packer 42 and is configured to receive wellbore liquid 22 from casing conduit 32 and to generate pressurized wellbore liquid 24 therefrom.

As illustrated in FIG. 3, a wellbore gas 26 may flow within an annular space 79 within casing conduit 32. As illustrated, annular space 79 is defined between casing 30 and a tubing 78 that defines liquid discharge conduit 80. Annular space 79 also may be referred to herein as and/or may be a gas discharge conduit 79. As also illustrated in FIG. 3, a plurality of sensors 92 may detect a plurality of downhole process parameters at, or near, an inlet 66 to downhole piezoelectric pump 40 and/or at, or near, an outlet 67 from the downhole piezoelectric pump. A sand control structure 44 may restrict flow of sand from subterranean formation 16, through perforations 36, and into wellbore 32. In addition, a gas control structure 46 may restrict flow of wellbore gas 26 into the downhole piezoelectric pump.

FIG. 3 further illustrates that downhole piezoelectric pump 40 may include one or more inlet check valves 69. Inlet check valve 69 may be configured to permit wellbore liquid 22 to enter a compression chamber 64 of the downhole piezoelectric pump from wellbore 32. However, the inlet check valve may resist, restrict, and/or block flow of pressurized wellbore liquid 24 therethrough and/or back into wellbore 32. This may permit creation of pressurized wellbore liquid 24 and/or pumping of pressurized wellbore liquid 24 from wellbore 32 via liquid discharge conduit 80.

As also illustrated in FIG. 3, downhole piezoelectric pump 40 further may include one or more outlet check valves 68. Outlet check valve 68 may be configured to permit pressurized wellbore liquid 24 to enter liquid discharge conduit 80 from compression chamber 64 of downhole piezoelectric pump 40. However, the outlet check valve may resist, restrict, and/or block flow of pressurized wellbore liquid 24 from liquid discharge conduit 80 into compression chamber 64. This further may permit creation of pressurized wellbore liquid 24 and/or pumping of the pressurized wellbore liquid from wellbore 32 via liquid discharge conduit 80.

Inlet check valve 69 and/or outlet check valve 68 may include any suitable structure. As illustrative, non-exclusive examples, inlet check valve 69 and/or outlet check valve 68 may include and/or be a mechanically actuated check valve and/or a check valve that is not electrically actuated. As a further illustrative, non-exclusive example, inlet check valve 69 and/or outlet check valve 68 may be an electrically actuated and/or electrically controlled check valve.

Compression chamber 64 may define a volume that varies with a state of a piezoelectric element 60 of downhole piezoelectric pump 40. Thus, compression chamber 64 may define an expanded volume when the piezoelectric element is in a contracted state (as schematically illustrated in solid lines in FIG. 3). Conversely, compression chamber 64 may define a contracted volume when piezoelectric element 60 is in an extended state (as schematically illustrated in dash-dot lines in FIG. 3). In addition, and as illustrated, the expanded volume may be greater than the contracted volume.

As illustrative, non-exclusive examples, the expanded volume may be at least 5 cubic centimeters, at least 10 cubic centimeters, at least 20 cubic centimeters, at least 30 cubic centimeters, at least 40 cubic centimeters, at least 50 cubic centimeters, at least 60 cubic centimeters, at least 70 cubic centimeters, at least 80 cubic centimeters, at least 90 cubic centimeters, and/or at least 100 cubic centimeters greater than the contracted volume. Additionally or alternatively, the expanded volume also may be less than 400 cubic centimeters, less than 350 cubic centimeters, less than 300 cubic centimeters, less than 250 cubic centimeters, less than 200 cubic centimeters, less than 180 cubic centimeters, less than 160 cubic centimeters, less than 140 cubic centimeters, less than 120 cubic centimeters, and/or less than 100 cubic centimeters greater than the contracted volume. As further illustrative, non-exclusive examples, the expanded volume may be in a range defined by any combination of the preceding minimum and maximum values.

As illustrated in FIG. 3, downhole piezoelectric pump 40 further may include a housing 50. Housing 50 may at least partially define compression chamber 64. Additionally or alternatively, piezoelectric element 60 may be located at least partially within housing 50. In addition, and as discussed in more detail herein with reference to FIGS. 4-5, downhole piezoelectric pump 40 further may include a sealing structure 72 and/or an isolation structure 74.

Figure 4:
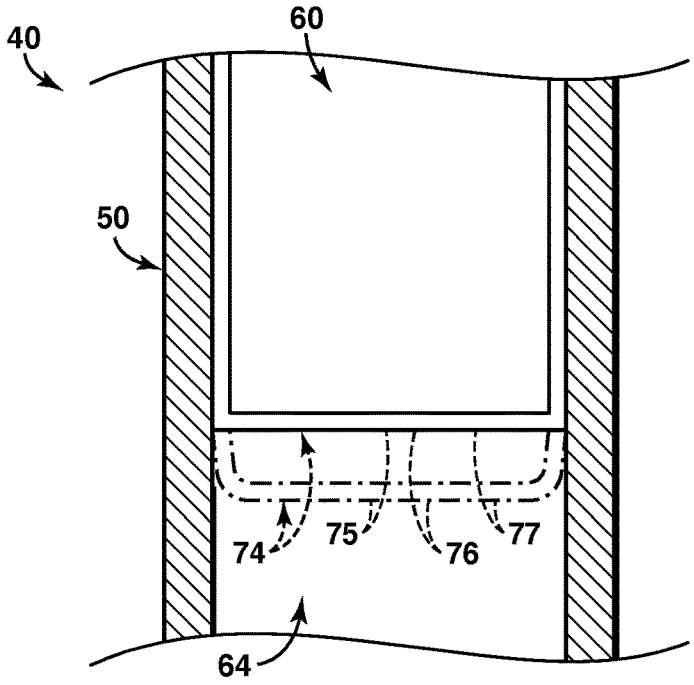
FIG. 4 is a fragmentary partial cross-sectional view of less schematic but still illustrative, non-exclusive examples of a downhole piezoelectric pump according to the present disclosure.

FIG. 4 provides less schematic but still illustrative, non-exclusive examples of a portion of a downhole piezoelectric pump 40 according to the present disclosure that includes an isolation structure 74. Isolation structure 74 may be configured to fluidly isolate piezoelectric element 60 from compression chamber 64. This may include fluidly isolating the piezoelectric element from the compression chamber when the piezoelectric element is in the contracted state (as illustrated in solid lines in FIG. 4) as well as fluidly isolating the piezoelectric element from the compression chamber when the piezoelectric element is in the extended state (as illustrated in dash-dot lines in FIG. 4).

Isolation structure 74 may include any suitable structure. As illustrative, non-exclusive examples, isolation structure 74 may include and/or be a flexible isolation structure 75, a diaphragm 76, and/or an isolation coating 77.

Figure 5:
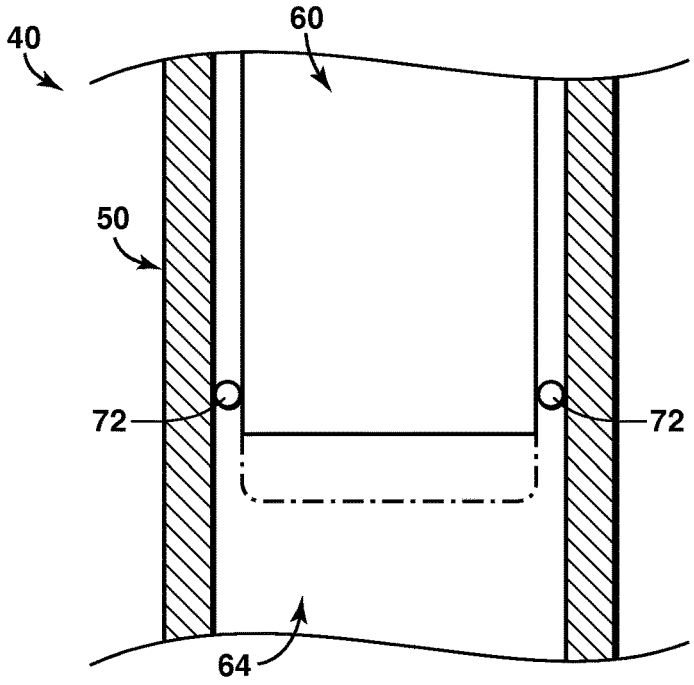
FIG. 5 is a fragmentary partial cross-sectional view of additional less schematic but still illustrative, non-exclusive examples of a downhole piezoelectric pump according to the present disclosure.

FIG. 5 provides additional less schematic but still illustrative, non-exclusive examples of a downhole piezoelectric pump 40 according to the present disclosure that includes a sealing structure 72. Sealing structure 72 may be configured to create a fluid seal between piezoelectric element 60 and housing 50 during (or despite) motion of piezoelectric element 60 and/or transitioning of the piezoelectric element between the contracted state (as illustrated in solid lines in FIG. 5) and the extended state (as illustrated in dash-dot lines in FIG. 5). Thus, sealing structure 72 may permit piezoelectric element 60 to transition between the extended state and the contracted state while restricting fluid flow from compression chamber 64 past the sealing structure.

Sealing structure 72 may include any suitable structure. As an illustrative, non-exclusive example, sealing structure 72 may include and/or be at least one O-ring.

Figure 6:
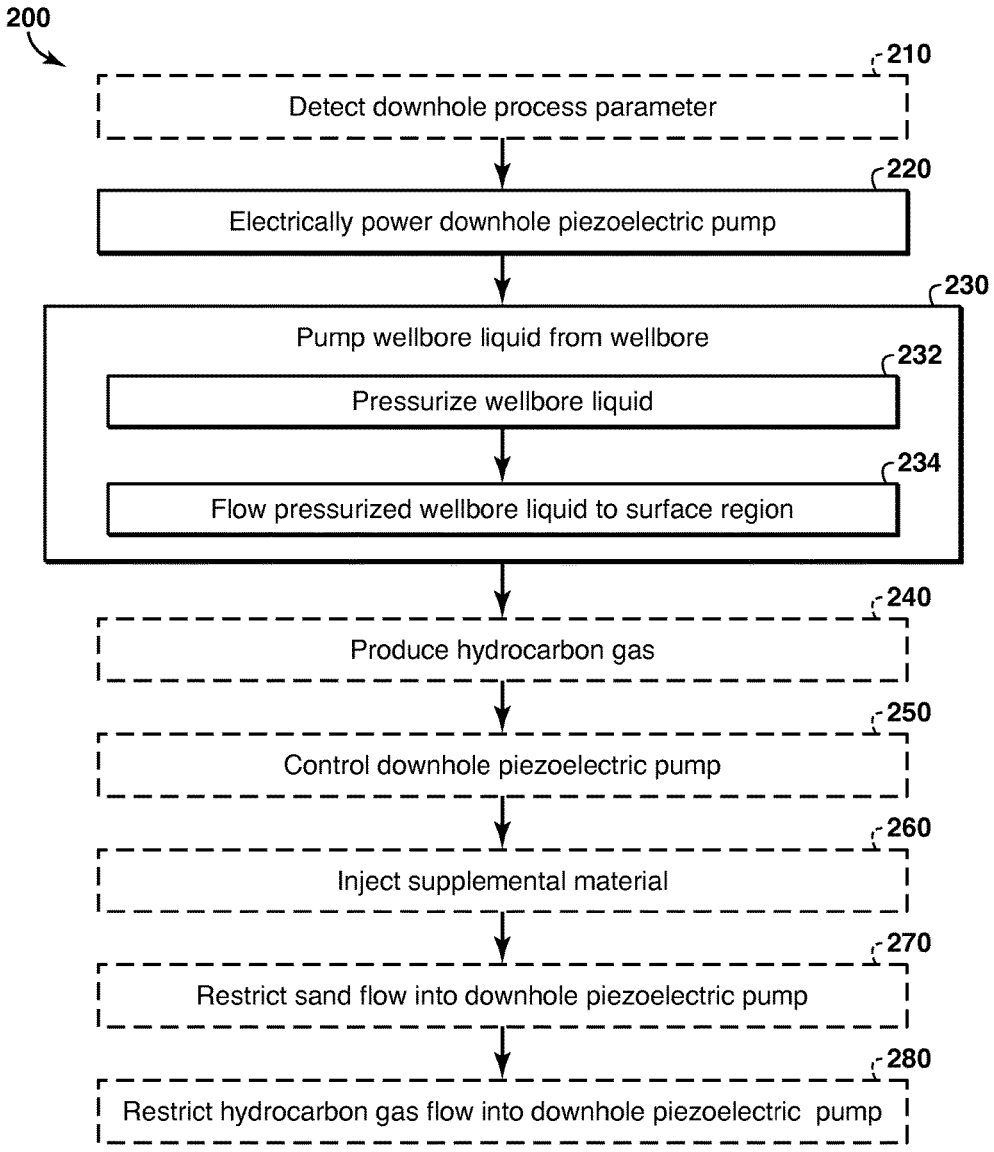
FIG. 6 is a flowchart depicting methods according to the present disclosure of removing a wellbore liquid from a wellbore.

FIG. 6 is a flowchart depicting methods 200 according to the present disclosure of removing a wellbore liquid from a wellbore that extends within a subterranean formation. Methods 200 may include detecting a downhole process parameter at 210 and include electrically powering a downhole piezoelectric pump at 220 and pumping the wellbore liquid from the wellbore at 230. Methods 200 further may include producing a hydrocarbon gas at 240, controlling the operation of a downhole piezoelectric pump at 250, injecting a supplemental material into the wellbore at 260, restricting sand flow into the downhole piezoelectric pump at 270, and/or restricting hydrocarbon gas flow into the downhole piezoelectric pump at 280.

Detecting the downhole process parameter at 210 may include detecting any suitable downhole process parameter that is indicative of any suitable condition within the wellbore. As illustrative, non-exclusive examples, the downhole process parameter may be collected at, or near, an inlet to the downhole piezoelectric pump, may be indicative of a condition at, or near, the inlet to the downhole piezoelectric pump, may be collected at, or near, an outlet from the downhole piezoelectric pump, and/or may be indicative of a condition at, or near, the outlet from the downhole piezoelectric pump. Illustrative, non-exclusive examples of the downhole process parameter are discussed herein. When methods 200 include the detecting at 210, methods 200 further may include communicating the downhole process parameter to a surface region and/or utilizing the downhole process parameter to control the operation of the downhole piezoelectric pump.

Electrically powering the downhole piezoelectric pump at 220 may include electrically powering the downhole piezoelectric pump with any suitable electric current that may be provided to the downhole piezoelectric pump and/or generated in any suitable manner. As an illustrative, non-exclusive example, the electrically powering at 220 may include conveying an electric current from the surface region to the downhole piezoelectric pump, such as via an electrical conduit, and providing the electric current to the downhole piezoelectric pump. Additionally or alternatively, the electrically powering at 220 also may include generating the electric current within the wellbore and conveying the electric current to the downhole piezoelectric pump. Illustrative, non-exclusive examples of the electrical conduit and/or the electric current are discussed in more detail herein.

Pumping the wellbore liquid from the wellbore at 230 may include pumping the wellbore liquid from the wellbore with the downhole piezoelectric pump. This may include pressurizing, at 232, the wellbore liquid within the downhole piezoelectric pump to generate a pressurized wellbore liquid at a discharge pressure and/or flowing, at 234, the pressurized wellbore liquid at least a threshold vertical distance to the surface region at a discharge flow rate.

The pumping at 230 may include at least substantially continuously pumping the wellbore liquid from the wellbore and/or pumping the pressurized wellbore liquid through a liquid discharge conduit that extends within the wellbore and/or between the downhole piezoelectric pump and the surface region. Illustrative, non-exclusive examples of the discharge pressure include discharge pressures of at least 20 megapascals (MPa), at least 25 MPa, at least 30 MPa, at least 35 MPa, at least 40 MPa, at least 45 MPa, at least 50 MPa, at least 55 MPa, at least 60 MPa, at least 65 MPa, and/or at least 70 MPa. Additionally or alternatively, the discharge pressure also may be less than 100 MPa, less than 95 MPa, less than 80 MPa, less than 75 MPa, less than 70 MPa, less than 65 MPa, less than 60 MPa, less than 55 MPa, and/or less than 50 MPa. Further additionally or alternatively, the discharge pressure may be in a range bounded by any combination of the preceding minimum and maximum discharge pressures.

The discharge pressure (in kilopascals) also may be at least a threshold multiple of the threshold vertical distance (in meters). Illustrative, non-exclusive examples of the threshold multiple include threshold multiples of at least 5, at least 6, at least 7, at least 8, at least 9, at least 10, at least 11, and/or at least 12.

Illustrative, non-exclusive examples of the discharge flow rate include discharge flow rates of at least 0.5, at least 0.75, at least 1, at least 2, at least 3, at least 4, at least 5, at least 6, at least 7, at least 8, at least 9, at least 10, at least 12, at least 14, at least 16, at least 18, at least 20, at least 22, at least 24, at least 26, at least 28, and/or at least 30 cubic meters per day. Additionally or alternatively, the discharge flow rate also may be less than 40, less than 38, less than 36, less than 34, less than 32, less than 30, less than 28, less than 26, less than 24, less than 22, less than 20, less than 18, less than 16, less than 14, less than 12, less than 10, less than 9, less than 8, less than 7, less than 6, less than 5, less than 4, less than 3, less than 2, and/or less than 1 cubic meters per day. Further additionally or alternatively, the discharge flow rate may be a range bounded by any combination of the preceding minimum and maximum discharge flow rates.

The pumping at 230 further may include pumping with at least a threshold pumping efficiency. Illustrative, non-exclusive examples of the threshold pumping efficiency include threshold pumping efficiencies of at least 50%, at least 55%, at least 60%, at least 65%, at least 70%, at least 75%, and/or at least 80%.

As a more specific but still illustrative, non-exclusive example, the downhole piezoelectric pump may include a piezoelectric element, and the pumping at 230 may include repeatedly transitioning the piezoelectric element from an extended state to a contracted state during an intake stroke of the downhole piezoelectric pump and/or subsequently transitioning the piezoelectric element from the contracted state to the expanded state during an exhaust stroke of the downhole piezoelectric pump. The downhole piezoelectric pump further may include a compression chamber, and the piezoelectric element may be configured to define and/or regulate a volume of the compression chamber. Thus, the pumping at 230 further may include receiving the wellbore liquid into the compression chamber during the intake stroke and/or emitting the pressurized wellbore liquid from the compression chamber during the exhaust stroke.

The pumping at 230 also may include selectively permitting flow of the wellbore liquid from the wellbore into the compression chamber and also selectively restricting, or resisting, flow of the pressurized wellbore liquid from the compression chamber into the wellbore. This may include selectively permitting and/or selectively resisting with an inlet check valve, such as inlet check valve 69.

Additionally or alternatively, the pumping at 230 also may include selectively permitting flow of the pressurized wellbore liquid from the compression chamber into a liquid discharge conduit and also selectively restricting, or resisting, flow of the pressurized wellbore liquid from the liquid discharge conduit into the compression chamber. This may include selectively permitting and/or selectively resisting with an outlet check valve, such as outlet check valve 68.

It is within the scope of the present disclosure that the pumping at 230 further may include emitting a volume of the pressurized wellbore liquid from the downhole piezoelectric pump during the exhaust stroke of the downhole piezoelectric pump. As illustrative, non-exclusive examples, the emitting may include emitting at least 5 cubic centimeters, at least 10 cubic centimeters, at least 20 cubic centimeters, at least 30 cubic centimeters, at least 40 cubic centimeters, at least 50 cubic centimeters, at least 60 cubic centimeters, at least 70 cubic centimeters, at least 80 cubic centimeters, at least 90 cubic centimeters, and/or at least 100 cubic centimeters of the pressurized wellbore liquid during the (or during each) exhaust stroke. Additionally or alternatively, the emitting also may include emitting less than 400 cubic centimeters, less than 350 cubic centimeters, less than 300 cubic centimeters, less than 250 cubic centimeters, less than 200 cubic centimeters, less than 180 cubic centimeters, less than 160 cubic centimeters, less than 140 cubic centimeters, less than 120 cubic centimeters, and/or less than 100 cubic centimeters of the pressurized wellbore liquid during the (or during each) exhaust stroke. Further additionally or alternatively, the emitting may include emitting pressurized wellbore fluid in a range bounded by any of the preceding minimum and maximum volumes during the (or during each) exhaust stroke.

The pumping at 230 also may include restricting contact between the wellbore liquid and at least a portion of the piezoelectric element. This may include restricting contact with any suitable structure, such as sealing structure 72 and/or isolation structure 74, which are discussed in more detail herein.

Producing the hydrocarbon gas at 240 may include producing the hydrocarbon gas from the subterranean formation and may be performed at least partially concurrently with the pumping at 230. As an illustrative, non-exclusive example, the producing at 240 may include producing through a gas discharge conduit that extends within the wellbore and/or between the subterranean formation and the surface region.

Controlling the operation of the downhole piezoelectric pump at 250 may include controlling the operation of any suitable portion of the downhole piezoelectric pump, and it is within the scope of the present disclosure that the controlling at 250 may be accomplished in any suitable manner. As illustrative, non-exclusive examples, the controlling at 250 may include automatically controlling, autonomously controlling, controlling with a controller that is located within the wellbore, controlling with a controller that is directly attached to the downhole piezoelectric pump, and/or controlling without requiring that a data signal be conveyed between the downhole piezoelectric pump and the surface region.

As illustrative, non-exclusive examples, the controlling at 250 may include controlling the discharge flow rate and/or the discharge pressure from the downhole piezoelectric pump. As another illustrative, non-exclusive example, and as discussed herein, the controlling at 250 also may include regulating a frequency of an AC electric current that is provided to the downhole piezoelectric pump during the electrically powering at 220.

As a more specific but still illustrative, non-exclusive example, the controlling at 250 also may include maintaining a target wellbore liquid level within the wellbore above the downhole piezoelectric pump (or an inlet thereof), such as to prevent (or decrease a potential for) a gas lock condition within the downhole piezoelectric pump. As another more specific but still illustrative, non-exclusive example, the detecting at 210 may include monitoring the discharge pressure from the downhole piezoelectric pump, and the controlling at 250 may include regulating the discharge flow rate to control the discharge pressure. This may include increasing the discharge flow rate to increase the discharge pressure and/or decreasing the discharge flow rate to decrease the discharge pressure.

As yet another more specific but still illustrative, non-exclusive example, the downhole piezoelectric pump may include a liquid inlet valve that is configured to selectively introduce the wellbore liquid into the compression chamber of the downhole piezoelectric pump. Under these conditions, the detecting at 210 may include detecting a gas lock condition of the downhole piezoelectric pump, and the controlling at 250 may include opening the liquid inlet valve responsive to detecting the gas lock condition.

Injecting the supplemental material into the wellbore at 260 may include injecting any suitable supplemental material into any suitable portion of the wellbore. As an illustrative, non-exclusive example, the injecting at 260 may include injecting a corrosion inhibitor and/or a scale inhibitor into the wellbore, such as to decrease a potential for corrosion of and/or scale buildup within the downhole piezoelectric pump and/or to increase a service life of the downhole piezoelectric pump. As another illustrative, non-exclusive example, the injecting at 260 also may include injecting downhole from the downhole piezoelectric pump, injecting into the downhole piezoelectric pump, and/or injecting such that the supplemental material flows through the downhole piezoelectric pump with the wellbore liquid.

Restricting sand flow into the downhole piezoelectric pump at 270 may include restricting using any suitable structure. As an illustrative, non-exclusive example, the restricting at 270 may include restricting with a sand filter. Similarly, restricting hydrocarbon gas flow into the downhole piezoelectric pump at 280 may include restricting using any suitable structure. As an illustrative, non-exclusive example, the restricting at 280 may include restricting with a gas-liquid separation assembly that is located upstream from, that is operatively attached to, and/or that forms a portion of the downhole piezoelectric pump.

Figure 7:
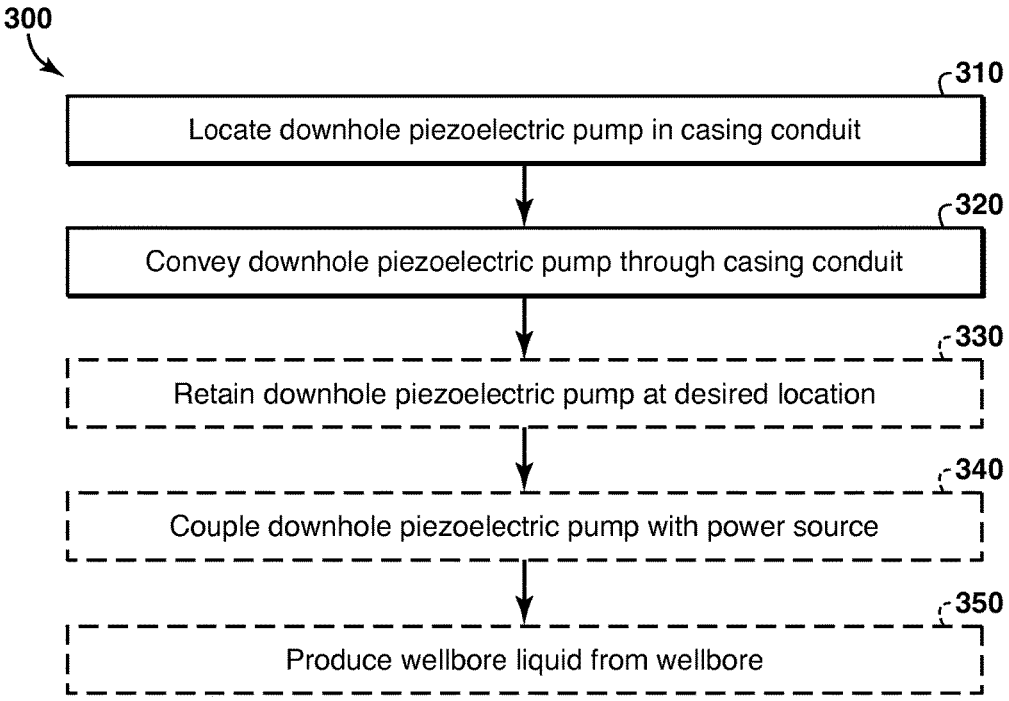
FIG. 7 is a flowchart depicting methods according to the present disclosure of locating a downhole piezoelectric pump within a wellbore.

FIG. 7 is a flowchart depicting methods 300 according to the present disclosure of locating a downhole piezoelectric pump within a wellbore that extends within a subterranean formation. Methods 300 include locating the downhole piezoelectric pump within a casing conduit at 310 and conveying the downhole piezoelectric pump through the casing conduit at 320. Methods 300 further may include retaining the downhole piezoelectric pump at a desired location within the casing conduit at 330, coupling the downhole piezoelectric pump with a power source at 340, and/or producing a wellbore liquid from the wellbore at 350.

Locating the downhole piezoelectric pump within the casing conduit at 310 may include locating the downhole piezoelectric pump in any suitable casing conduit that may be defined by a casing that extends within the wellbore. As an illustrative, non-exclusive example, the locating at 310 may include placing the downhole piezoelectric pump within a lubricator that is in selective fluid communication with the casing conduit and/or transferring the downhole piezoelectric pump from the lubricator to the casing conduit. As another illustrative, non-exclusive example, the locating at 310 also may include locating without first killing a hydrocarbon well that includes the wellbore, locating without supplying a kill weight fluid to the wellbore, locating while containing (all) wellbore fluids within the wellbore, and/or locating without depressurizing (or completely depressurizing) the wellbore (or at least a portion of the wellbore that is proximal to the surface region).

Conveying the downhole piezoelectric pump through the casing conduit at 320 may include conveying until the downhole piezoelectric pump is at least a threshold vertical distance from the surface region. Illustrative, non-exclusive examples of the threshold vertical distance are disclosed herein.

It is within the scope of the present disclosure that the casing conduit may define a nonlinear trajectory and/or a nonlinear region and that the conveying at 320 may include conveying along the nonlinear trajectory, through the nonlinear region, and/or past the nonlinear region. Illustrative, non-exclusive examples of the nonlinear region and/or the nonlinear trajectory are discussed herein.

The conveying may be accomplished in any suitable manner. As an illustrative, non-exclusive example, the conveying may include establishing a fluid flow from the surface region, through the casing conduit, and into the subterranean formation; and the conveying at 320 may include flowing the downhole piezoelectric pump through the casing conduit with the fluid flow. As additional illustrative, non-exclusive examples, the conveying at 320 also may include conveying on a wireline, conveying with coiled tubing, conveying with rods, and/or conveying with a tractor.

Retaining the downhole piezoelectric pump at the desired location within the casing conduit at 330 may include retaining the downhole piezoelectric pump in any suitable manner. As an illustrative, non-exclusive example, the retaining at 330 may include swelling a packer that is operatively attached to the downhole piezoelectric pump to retain the downhole piezoelectric pump at the desired location. As another illustrative, non-exclusive example, the retaining at 330 also may include locating the downhole piezoelectric pump on a seat that is present within the casing conduit and that is configured to receive and/or to retain the downhole piezoelectric pump.

Coupling the downhole piezoelectric pump with the power source at 340 may include coupling the downhole piezoelectric pump with the power source subsequent to the conveying at 320. Illustrative, non-exclusive examples of the power source are disclosed herein.

Producing the wellbore liquid from the wellbore at 350 may include producing the wellbore liquid with the downhole piezoelectric pump and may be accomplished in any suitable manner. As an illustrative, non-exclusive example, the producing at 350 may be at least substantially similar to the pumping at 230, which is discussed in more detail herein.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently. It is also within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices. The illustrated blocks may, but are not required to, represent executable instructions that cause a computer, processor, and/or other logic device to respond, to perform an action, to change states, to generate an output or display, and/or to make decisions.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

INDUSTRIAL APPLICABILITY

The systems and methods disclosed herein are applicable to the oil and gas industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

The invention claimed is:

1. A method of removing wellbore liquid from a wellbore that extends from a surface location into a subterranean formation, the method comprising:

providing a downhole piezoelectric pump within the wellbore, the downhole piezoelectric pump comprising a liquid inlet valve configured to selectively introduce the wellbore liquid into a compression chamber of the downhole piezoelectric pump;

electrically powering the downhole piezoelectric pump; and pumping the wellbore liquid from the wellbore with the downhole piezoelectric pump, wherein the pumping includes:

(i) pressurizing the wellbore liquid with the downhole piezoelectric pump to generate a pressurized wellbore liquid at a discharge pressure; and (ii) flowing the pressurized wellbore liquid at least a threshold vertical distance to a surface region;

(iii) detecting a gas lock condition of the downhole piezoelectric pump; and (iv) opening the liquid inlet valve responsive to detecting the gas lock condition.

2. The method of claim 1, wherein the discharge pressure is at least 25 MPa.

3. The method of claim 1, wherein the pumping includes continuously pumping the wellbore liquid from the wellbore.

4. The method of claim 1, wherein the method further includes producing a hydrocarbon gas from the subterranean formation at least partially concurrently with the pumping.

5. The method of claim 1, wherein the pumping includes pumping with at least a threshold pumping efficiency of at least 50%.

6. The method of claim 1, wherein the downhole piezoelectric pump includes a piezoelectric element, and further wherein the pumping includes repeatedly transitioning the piezoelectric element from an extended state to a contracted state during an intake stroke of the downhole piezoelectric pump and subsequently transitioning the piezoelectric element from the contracted state to the extended state during an exhaust stroke of the downhole piezoelectric pump.

7. The method of claim 6, wherein the downhole piezoelectric pump includes a compression chamber, and further wherein the method includes receiving the wellbore liquid into the compression chamber during the intake stroke of the downhole piezoelectric pump and emitting the pressurized wellbore liquid during the exhaust stroke of the downhole piezoelectric pump.

8. The method of claim 7, wherein the method further includes selectively permitting flow of the wellbore liquid from the wellbore into the compression chamber and selectively restricting fluid flow from the compression chamber into the wellbore, and further wherein the method includes selectively permitting flow of the pressurized wellbore liquid from the compression chamber into a liquid discharge conduit and selectively restricting fluid flow from the liquid discharge conduit into the compression chamber, optionally with an outlet check valve.

9. The method of claim 7, wherein the pumping includes emitting at least 5 cubic centimeters but not more than 400 cubic centimeters of the pressurized wellbore liquid from the downhole piezoelectric pump during the exhaust stroke of the downhole piezoelectric pump.

10. The method of claim 1, wherein the method further includes detecting a downhole process parameter.

11. The method of claim 10, wherein the downhole process parameter includes at least one of a downhole temperature, a downhole pressure, the discharge pressure, a downhole flow rate, and the discharge flow rate.

12. The method of claim 1, wherein the method further includes controlling at least one of the discharge flow rate and the discharge pressure.

13. The method of claim 12, wherein the electrically powering includes providing an AC electric current to the downhole piezoelectric pump and further wherein the controlling includes regulating a frequency of the AC electric current.

14. The method of claim 12, wherein the method includes monitoring the discharge pressure, wherein the controlling includes regulating the discharge flow rate to control the discharge pressure, and further wherein the controlling includes at least one of:

(i) increasing the discharge flow rate to increase the discharge pressure; and (ii) decreasing the discharge flow rate to decrease the discharge pressure.

15. The method of claim 7, wherein the compression chamber defines a restricted volume when the piezoelectric element is in the extended state and an expanded volume when the piezoelectric element is in the contracted state, wherein the expanded volume is greater than the restricted volume, and further wherein a difference between the expanded volume and the restricted volume is within a range of at least 5 cubic centimeters and up to and including 400 cubic centimeters.

16. The method of claim 1, wherein the threshold vertical distance is at least 1000 meters.

17. The method of claim 1, wherein a length of the downhole piezoelectric pump is less than 10 meters.

18. The method of claim 1, wherein the downhole piezoelectric pump includes not more than three sequential stages of further pressurizing the wellbore liquid with the downhole piezoelectric pump in order to pump the wellbore liquid to the surface.

19. The method of claim 1, further comprising pumping the pressurized wellbore liquid to a surface region at a discharge flow rate range of at least 0.75 cubic meters per day.

* * * * *